US006341380B1

(12) United States Patent
Coleman

(10) Patent No.: US 6,341,380 B1
(45) Date of Patent: Jan. 29, 2002

(54) PROTECTIVE RAIN HAT

(76) Inventor: Arthur Coleman, P.O. Box 880641, San Francisco, CA (US) 94188

( * ) Notice: Subject to any disclaimer, the term of this patent is extended or adjusted under 35 U.S.C. 154(b) by 0 days.

(21) Appl. No.: 09/546,008

(22) Filed: Apr. 8, 2000

(51) Int. Cl.[7] ..... A42B 1/00
(52) U.S. Cl. ..... 2/175.1; 2/171; 2/DIG. 1
(58) Field of Search ..... 2/DIG. 1, 171, 2/171.3, 172, 184.5, 175.1

(56) References Cited

U.S. PATENT DOCUMENTS 138,430 A * 4/1873 O'Donnell ..... 2/175.1
1,175,167 A * 3/1916 Mosherrosch et al. ..... 2/175.1
2,416,062 A * 2/1947 Mercer ..... 2/175.1
2,874,387 A * 2/1959 Bannister et al. ..... 2/175.1
3,097,363 A * 7/1963 LeBlanc ..... 2/175.1
3,927,421 A * 12/1975 Simon ..... 2/12
5,487,191 A * 1/1996 Ridley ..... 2/195.1
6,151,712 A * 11/2000 Lampi ..... 2/10

* cited by examiner

*Primary Examiner*—Bibhu Mohanty
(74) *Attorney, Agent, or Firm*—Goldstein Law Offices P.

(57) ABSTRACT

A protective rain hat including a head portion having a dome-like configuration. The head portion has an interior surface and an exterior surface. The interior surface receives the head of a user therein. The head portion has a peripheral edge. An annular brim portion is coupled with the head portion. The annular brim portion has an upper peripheral edge and a lower peripheral edge. The upper peripheral edge is secured to the peripheral edge of the head portion. The annular brim portion is arcuate whereby the lower peripheral edge is disposed in a lower plane than the upper peripheral edge. The annular brim portion has a plurality of air vents disposed therein in a spaced relationship.

6 Claims, 2 Drawing Sheets

PROTECTIVE RAIN HAT

BACKGROUND OF THE INVENTION

The present invention relates to a protective rain hat and more particularly pertains to preventing rain from wetting the head and the face.

The use of head protecting garments is known in the prior art. More specifically, head protecting garments heretofore devised and utilized for the purpose of protecting the head are known to consist basically of familiar, expected and obvious structural configurations, notwithstanding the myriad of designs encompassed by the crowded prior art which have been developed for the fulfillment of countless objectives and requirements.

By way of example, U.S. Pat. No. 4,675,916 to Orsini discloses a wide brimmed hat for providing an umbrella like covering to protect the user's head and upper body from precipitation. Orsini appears to disclose the use of a covering secured by a flexible headband and constructed of a transparent material. U.S. Pat. No. 4,760,610 to Wu discloses an umbrella hat with a foldable canopy assembly. U.S. Pat. No. 1,560,073 to Bontempi discloses a hat protecting device for shielding a person from rain and is comprised of a plurality of inflatable ribs. U.S. Pat. No. 1,772,740 to Anderson discloses a foldable head supported umbrella comprised of water resistant paper.

While these devices fulfill their respective, particular objective and requirements, the aforementioned patents do not describe a protective rain hat for preventing rain from wetting the head and the face.

In this respect, the protective rain hat according to the present invention substantially departs from the conventional concepts and designs of the prior art, and in doing so provides an apparatus primarily developed for the purpose of preventing rain from wetting the head and the face.

Therefore, it can be appreciated that there exists a continuing need for a new and improved protective rain hat which can be used for preventing rain from wetting the head and the face. In this regard, the present invention substantially fulfills this need.

SUMMARY OF THE INVENTION

In the view of the foregoing disadvantages inherent in the known types of head protecting garments now present in the prior art, the present invention provides an improved protective rain hat. As such, the general purpose of the present invention, which will be described subsequently in greater detail, is to provide a new and improved protective rain hat which has all the advantages of the prior art and none of the disadvantages.

To attain this, the present invention essentially comprises a head portion having a dome-like configuration. The head portion has an interior surface and an exterior surface. The interior surface receives the head of a user therein. The head portion has a peripheral edge. A head support strap is removably coupled with the interior surface of the head portion. The head support strap is comprised of a circular band dimensioned for positioning over the head of the user. The circular band includes a support matrix for positioning atop the head of the user. The support matrix is removably coupled with the interior surface of the head portion. The support matrix includes a circular top support. The circular band has a pair of diametrically opposed straps secured thereto. Each of the straps have a free end having hook and loop patches disposed thereon. The straps extend under a chin of the user with the hook and loop patches mating for securement of the head support strap and the head portion to the user. An annular brim portion is coupled with the head portion. The annular brim portion has an upper peripheral edge and a lower peripheral edge. The upper peripheral edge is secured to the peripheral edge of the head portion. The annular brim portion is arcuate whereby the lower peripheral edge is disposed in a lower plane than the upper peripheral edge. The annular brim portion has a plurality of air vents disposed therein in a spaced relationship.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved protective rain hat which has all the advantages of the prior art head protecting garments and none of the disadvantages.

It is another object of the present invention to provide a new and improved protective rain hat which may be easily and efficiently manufactured and marketed.

It is a further object of the present invention to provide a new and improved protective rain hat which is of durable and reliable construction.

An even further object of the present invention is to provide a new and improved protective rain hat which is susceptible of a low cost of manufacture with regard to both materials and labor, and which accordingly is then susceptible of low prices of sale to the consuming public, thereby making such a protective rain hat economically available to the buying public.

Even still another object of the present invention is to provide a new and improved protective rain hat for preventing rain from wetting the head and the face.

Lastly, it is an object of the present invention to provide a new and improved protective rain hat including a head portion having a dome-like configuration. The head portion has an interior surface and an exterior surface. The interior surface receives the head of a user therein. The head portion has a peripheral edge. An annular brim portion is coupled with the head portion. The annular brim portion has an upper peripheral edge and a lower peripheral edge. The upper peripheral edge is secured to the peripheral edge of the head portion. The annular brim portion is arcuate whereby the lower peripheral edge is disposed in a lower plane than the upper peripheral edge. The annular brim portion has a plurality of air vents disposed therein in a spaced relationship.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings. wherein.

The same reference numerals refer to the same parts through the various figures.

DESCRIPTION OF THE PREFERRED EMBODIMENT

Figure 1:
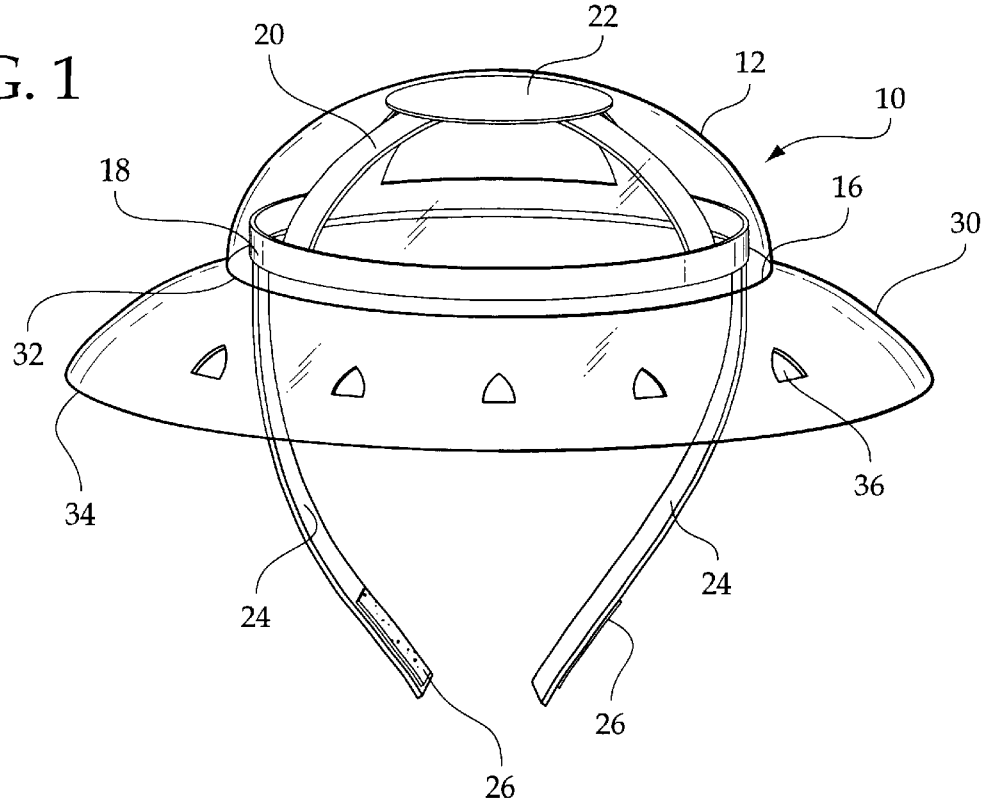
FIG. 1 is a perspective view of the preferred embodiment of the protective rain hat constructed in accordance with the principles of the present invention.
Figure 2:
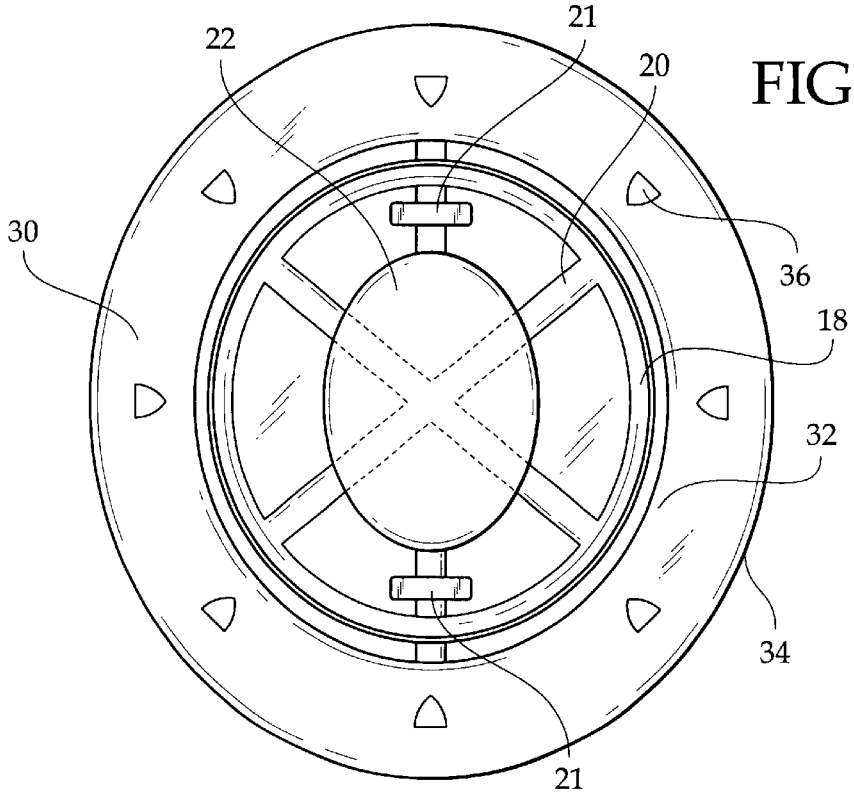
FIG. 2 is a top plan view of the present invention.
Figure 3:
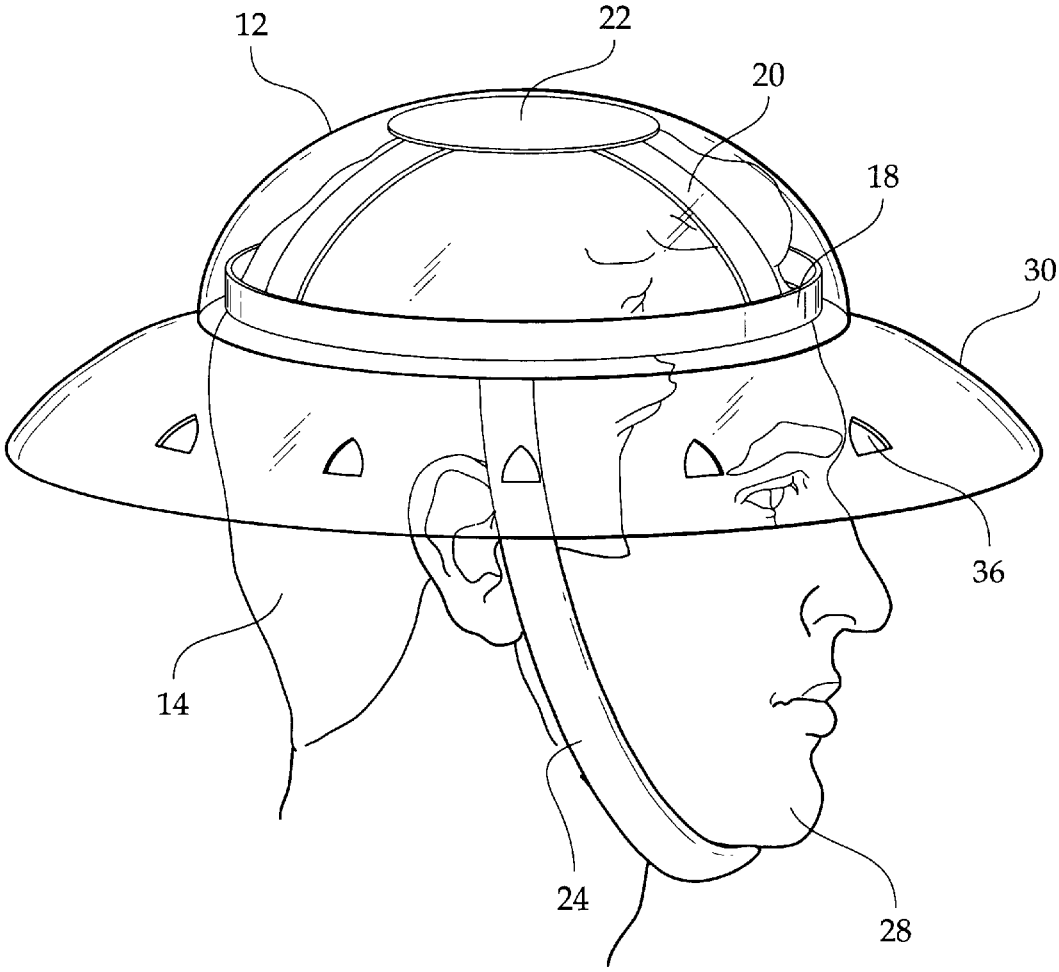
FIG. 3 is a side view of the present invention illustrated in use.

With reference now to the drawings, and in particular, to FIGS. 1 through 3 thereof, the preferred embodiment of the new and improved protective rain hat embodying the principles and concepts of the present invention and generally designated by the reference number 10 will be described.

Specifically, it will be noted in the various Figures that the device relates to a protective rain hat for preventing rain from wetting the head and the face. In its broadest context, the device consists of a head portion, a head support strap, and an annular brim portion. Such components are individually configured and correlated with respect to each other so as to attain the desired objective.

The head portion 12 has a dome-like configuration. The head portion 12 has an interior surface and an exterior surface. The interior surface receives the head 14 of a user therein. The head portion 12 has a peripheral edge 16. The head portion 12 is preferably constructed of a transparent plastic that is lightweight, yet durable. The head portion 12 can be constructed in numerous sizes so as to fit heads of varying sizes.

The head support strap is removably coupled with the interior surface of the head portion 12. The head support strap is comprised of a circular band 18 dimensioned for positioning over the head 14 of the user. The circular band 18 includes a support matrix 20 for positioning atop the head of the user. The support matrix 20 is comprised of four upwardly extending segments that merge at an apex. Note FIG. 2. The support matrix 20 is removably coupled with the interior surface of the head portion 12. This coupling is facilitated through the use of hook and loop fasteners 21 or other type of similar coupling. The support matrix 20 includes a circular top support 22. The circular top support 22 will rest atop of the head 14 when the device 10 is in use. The circular band 18 has a pair of diametrically opposed straps 24 secured thereto. Each of the straps 24 have a free end having hook and loop patches 26 disposed thereon. The straps 24 extend under a chin 28 of the user with the hook and loop patches 26 mating for securement of the head support strap and the head portion 12 to the user.

The annular brim portion 30 is coupled with the head portion 12. The annular brim portion 30 is preferably constructed of a durable transparent plastic. The annular brim portion 30 has an upper peripheral edge 32 and a lower peripheral edge 34. The upper peripheral edge 32 is secured to the peripheral edge 16 of the head portion 12. The annular brim portion 30 is arcuate whereby the lower peripheral edge 34 is disposed in a lower plane than the upper peripheral edge 32. The design of the annular brim portion 30 will serve to direct rain water down and away from the face of the user. The annular brim portion 30 has a plurality of air vents 36 disposed therein in a spaced relationship. The air vents 36 are constructed with slight openings to prevent rain water from entering therethrough. The air vents 36 will reduce the effect of windy conditions.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modification and changes will readily occur to those skilled in the art, it is not desired to limit the invention to the exact construction and operation shown and described, and accordingly, all suitable modification and equivalents may be resorted to, falling within the scope of the invention.

What is claimed as being new and desired to be protected by Letters Patent of the United States is as follows:

1. A protective rain hat for preventing rain from wetting the head and the face comprising, in combination:

a head portion having a dome-like configuration, the head portion having an interior surface and an exterior surface, the interior surface receiving the head of a user therein, the head portion having a peripheral edge;

a head support strap removably coupled with the interior surface of the head portion, the head support strap comprised of a circular band dimensioned for positioning over the head of the user, the circular band including a support matrix for positioning atop the head of the user, the support matrix being removably coupled with the interior surface of the head portion, the support matrix including a circular top support, the circular band having a pair of diametrically opposed straps secured thereto, each of the straps having a free end having hook and loop patches disposed thereon, the straps extending under a chin of the user with the hook and loop patches mating for securement of the head support strap and the head portion to the user;

an annular brim portion coupled with the head portion, the annular brim portion having an upper peripheral edge and a lower peripheral edge, the upper peripheral edge secured to the peripheral edge of the head portion, the annular brim portion being arcuate whereby the lower peripheral edge is disposed in a lower plane than the upper peripheral edge, the annular brim portion having a plurality of air vents disposed therein in a spaced relationship.

2. A protective rain hat for preventing rain from wetting the head and the face comprising, in combination:

a transparent plastic head portion having a dome-like configuration, the head portion having an interior surface and an exterior surface, the interior surface receiving the head of a user therein, the head portion having a peripheral edge;

a transparent plastic annular brim portion coupled with the head portion, the annular brim portion having an upper peripheral edge and a lower peripheral edge, the upper peripheral edge secured to the peripheral edge of the head portion, the annular brim portion being arcuate whereby the lower peripheral edge is disposed in a lower plane than the upper peripheral edge, the annular brim portion having a plurality of air vents disposed therein in a spaced relationship.

3. The protective rain hat as set forth in claim 2 and further including a head support strap removably coupled with the interior surface of the head portion, the head support strap comprised of a circular band dimensioned for positioning over the head of the user.

4. The protective rain hat as set forth in claim 3 wherein the circular band includes a support matrix for positioning atop the head of the user, the support matrix being removably coupled with the interior surface of the head portion.

5. The protective rain hat as set forth in claim 4 wherein the support matrix includes a circular top support.

6. The protective rain hat as set forth in claim 3 wherein the circular band has a pair of diametrically opposed straps secured thereto, each of the straps having a free end having hook and loop patches disposed thereon, the straps extending under a chin of the user with the hook and loop patches mating for securement of the head support strap and the head portion to the user.

* * * * *